United States Patent [19]

Flaherty

[11] Patent Number: 4,822,053

[45] Date of Patent: Apr. 18, 1989

[54] GAME BARRIER DEVICE

[76] Inventor: Eleanor L. Flaherty, 6050 Oak Hill La., Centerville, Ohio 45459

[21] Appl. No.: 894,268

[22] Filed: Aug. 7, 1986

Related U.S. Application Data

[63] Continuation-in-part of Ser. No. 745,270, Jun. 14, 1985, abandoned, which is a continuation-in-part of Ser. No. 526,043, Aug. 24, 1983, abandoned.

[51] Int. Cl.[4] ..... A63B 71/00

[52] U.S. Cl. ..... 273/411; 403/108; 403/379

[58] Field of Search ..... 273/411, 55 R, 55 D, 273/DIG. 30; 272/1 B, 105; 135/102, 105, 106, 109, DIG. 1, DIG. 9; 188/32; 403/108, 378, 379

[56] References Cited

U.S. PATENT DOCUMENTS

| | | | |
|---|---|---|---|
| 547,119 | 10/1895 | Heaton, Jr. et al. . | |
| 1,650,111 | 11/1927 | Byne . | |
| 2,484,401 | 10/1949 | Coie | 403/108 X |
| 2,525,881 | 10/1950 | Felter | 273/127 |
| 2,823,683 | 2/1958 | Smith et al. | 135/1 |
| 2,938,524 | 5/1960 | Benson | 135/1 |
| 3,170,171 | 2/1965 | Mayhew et al. | 272/1 B X |
| 3,501,150 | 3/1970 | Frischman | 273/127 |
| 3,536,327 | 10/1970 | Kaehne | 273/411 X |
| 3,752,472 | 8/1973 | Snead | 272/1 B X |
| 3,945,641 | 3/1976 | Carbonero | 273/411 |
| 4,183,691 | 1/1980 | Van Melle | 403/378 X |
| 4,273,130 | 6/1981 | Simpson | 128/327 |
| 4,364,560 | 12/1982 | Gemmel | 273/1 B |
| 4,588,191 | 5/1986 | Stewart | 273/194 B |

FOREIGN PATENT DOCUMENTS

| | | | |
|---|---|---|---|
| 275595 | 5/1964 | Australia | 403/379 |
| 1148656 | 4/1969 | United Kingdom | 403/379 |

*Primary Examiner*—William H. Grieb

*Attorney, Agent, or Firm*—Roger S. Dybvig

[57] ABSTRACT

An arch assembly for separating playing areas between contestants is formed from a rod made from plural sections of tubing removably interconnected by threaded connectors or by pins extending through aligned apertures and held by VELCRO ® straps. The ends of the rod are received within sockets in support members that may be staked or otherwise held down on a support surface. The separation between the support members is limited by a flexible cable connecting them. A cable having permanent stops and which may be knotted to form temporary stops may be used to vary the separation between the support members and thereby the height of the arch. A water hose connection may optionally be provided and a portion of the rod apertured to produce a water spray.

16 Claims, 4 Drawing Sheets

FIG-2
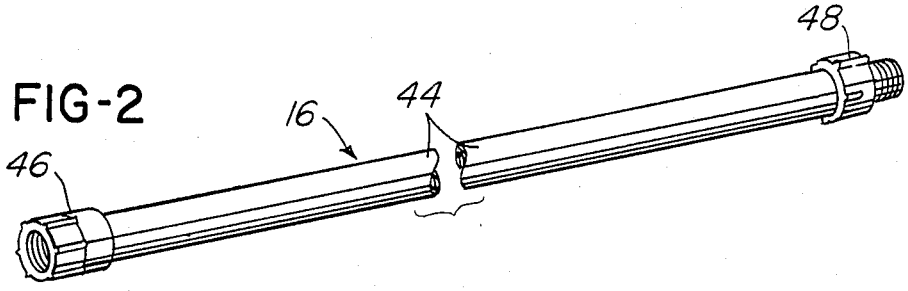
FIG-1
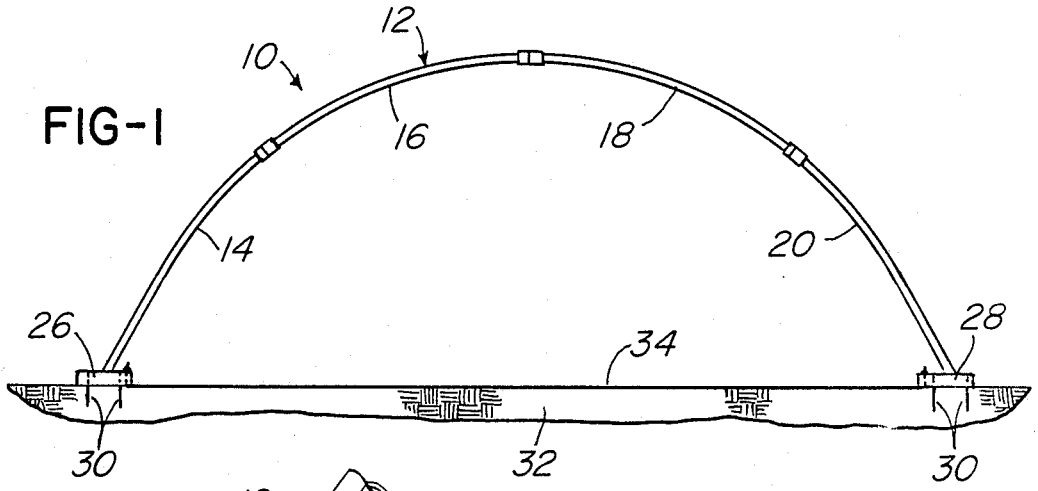
FIG-3
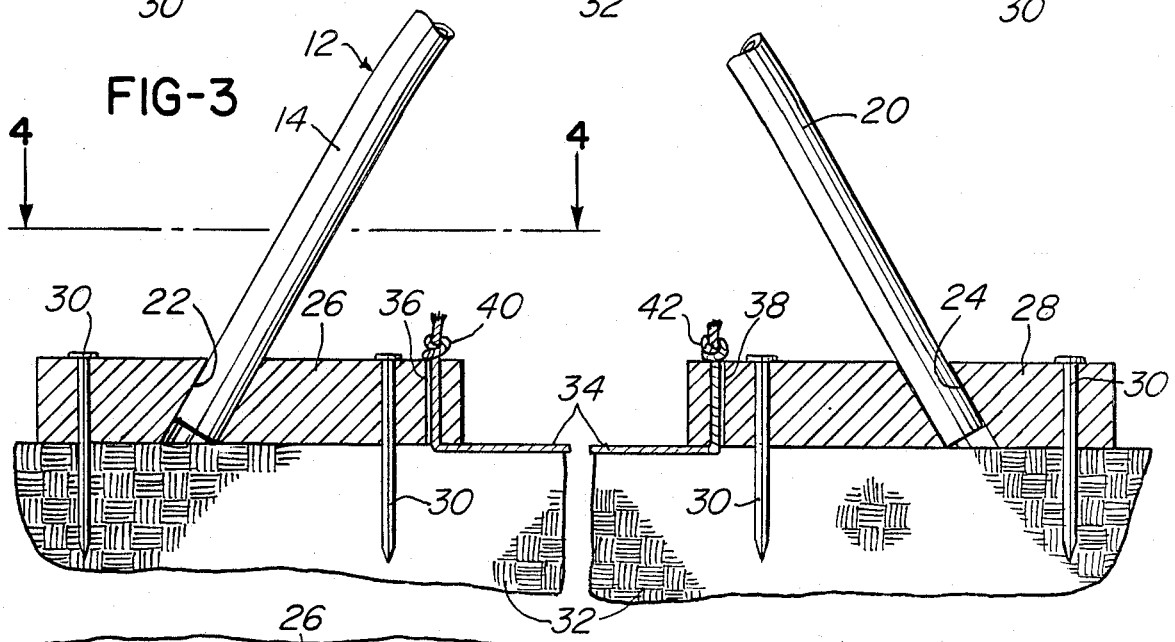
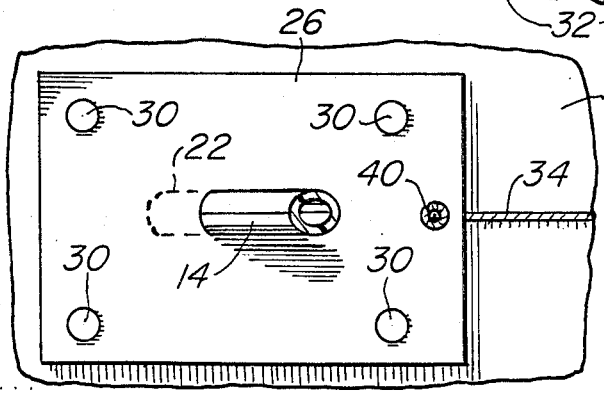
FIG-4

GAME BARRIER DEVICE

CROSS-REFERENCE TO RELATED APPLICATION

This is a continuation-in-part of application Ser. No. 745,270, filed June 14, 1985 now abandoned which was a continuation-in-part of application Ser. No. 526,043, filed Aug. 24, 1983, now abandoned.

SUMMARY OF THE INVENTION

This invention relates to a game barrier device and more particularly to a device that may be used in a manner similar to a net for separating contestant playing areas and providing a barrier over or under which balls, shuttlecocks and the like may be tossed or batted.

The apparatus of this invention is designed primarily for individual household use and for use in sporting events known as "field days" for children and young adults, and is intended for use in playing modifications of games that commonly utilize a net-type barrier or for newly devised games that may use a barrier.

Field days are often conducted in open fields having little or no permanently installed equipment. Games played with nets such as volleyball and badminton are very popular for field day events and similar sporting events for both the young and old. However, nets are by their very nature easily damaged and have a relatively short useful life. Portable net assemblies usually include a pair of net supporting posts which are maintained in an upright position by rope guys extended between the posts and stakes driven into the ground. These may be relatively difficult and time consuming to erect and the guys and stakes constitute a hazard to the contestants. For field day or household use or the like, when equipment is needed which is not permanent and subject to rough usage, I have recognized the need for a game barrier device that may be quickly assembled and disassembled and that is rugged, lightweight, and easily transported.

It is accordingly an object of this invention to provide a rugged, inexpensive, and safe game barrier device that may be quickly and easily assembled and disassembled.

It is a further object of this invention to provide such a device that can easily be mounted either on the ground or on a suitable floor or paved area in minimal time.

A further object of this invention is to provide a rugged, portable barrier device that may be easily lifted from the ground or other playing surface and disassembled into relatively small pieces so that it can be transported about.

A game barrier device of this invention comprises a long, substantially straight bar made from plural, connected, elongate sections of straight tubing that is bent into an arch shape during assembly. The ends of the bar are inserted into sockets formed i support members that are held fast to the ground or else held down on the floor or ground such as by weights.

Another object of this invention is to provide a portable game barrier device that may be quickly assembled to provide an arch having a predetermined height. Preferably, an elongate cable, which may be rope, is connected between the two support members and prevents the support members from being spread apart by more than a predetermined distance so that, during assembly, the support members may be spread apart by the maximum distance permitted by the cable whereupon the center of the arch will have a predetermined height above the supporting surface.

Still another object of this invention is to provide a portable game barrier device that may be quickly assembled and readily adjusted to provide arch configurations of different heights. Such a device is especially useful for field day or other events wherein groups of children of different ages may be involved. To this end, the elongate cable is so constructed, and its method of connection to at least one of the support members so arranged, as to permit the effective length of the cable to be either lengthened or shortened, so that the maximum spread of the support members from one another may be changed to produce arch configurations having different heights.

In a modification it is an object of this invention to provide such a device especially adapted for use by younger children in which the device is constructed to serve also as a water sprinkler that sends sprays of water outwardly and downwardly upon those near by. This may be accomplished by forming the bar from hollow tubing having plugged end portions, by providing the bar with a water hose connection, and by perforating portions of the bar so the water will spray from the hollow tubing.

Yet another object of this invention is to provide inexpensive means for simply, quickly and reliably connecting and disconnecting sections of arch-forming tubing in end-to-end relationship. Commercially available threaded connectors may be used but are subject to being broken under the substantial abuse to which game barrier devices used by active children may be subjected. In accordance with the presently preferred embodiment of this invention, improved means is provided that reliably prevents the tubing sections from separating when in use and that provides a more rugged assembly than is provided by threaded connectors. Such means includes a sleeve permanently affixed to and extending from one end of one tube and adapted to receive the end of another tube. Both the latter end and the sleeve have a pair of diametrically aligned apertures. To assemble the two tubes, the latter end of the one tube is inserted into the sleeve and the two pairs of apertures brought into alignment. Connection means in the form of a connector pin that is inserted through the aligned apertures and an elongate, flexible, fabric, fastener strap, through which the connector pin extends, encircles the sleeve and covers the ends of the pin to maintain the tubes interconnected. The fastener strap is of the type having an array of hooks along one face and loop pile covering its opposite face and sold under the trademark VELCRO® by VELCRO USA, Inc., 521 Fifth Ave., New York, N.Y. 10175.

Other objects and advantages of this invention will be apparent from the following description.

BRIEF DESCRIPTION OF THE DRAWINGS

FIG. 1 is a side elevational view of a game barrier device of this invention shown mounted on the ground which is shown in cross section.

FIG. 2 is an isometric view with parts broken away of a structural element which forms part of the device of FIG. 1.

FIG. 3 is an enlarged fragmentary cross-sectional view of the device of FIG. 1.

FIG. 4 is a cross-sectional view taken along line 4—4 of FIG. 3.

DESCRIPTION OF THE PREFERRED EMBODIMENTS

Figure 5:
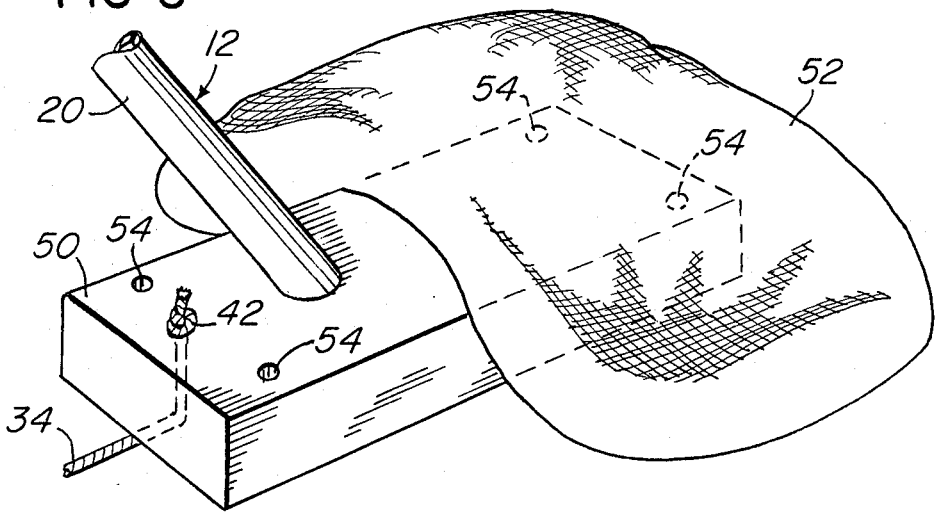
FIG. 5 is an isometric view of a portion of a modified game barrier device especially adapted for use on floors.

With reference to FIGS. 1-4, a game barrier device of this invention comprises an arch forming assembly 10 including a substantially free standing arch initially formed as a substantially straight bar 12 from plural, interconnected, elongate, hollow substantially rigid tubes 14, there being four such tubes illustrated in FIG. 1 and identified by reference numbers 14, 16, 18 and 20. The ends of the bar 12 are received in upwardly facing sockets 22 and 24 respectively, that comprise holes extending through a pair of support members 26 and 28, respectively. Support members 26 and 28 may have various different shapes. Each can be made, as illustrated, as a solid, rectangular plate or block of wood, plastic, or metal and provided with holes extending therethrough through which spikes 30 are driven into the ground 32. There are preferably at least four spike-receiving holes, one at each corner of each block.

The support members 26 and 28 are adapted to lie on the ground with their major surfaces facing upwardly and downwardly and the holes forming the sockets 22 and 24 having center axes that intersect the ground 32. As shown in FIG. 3, the center axis of the socket 24 at a point substantially above ground. Accordingly, these axes are angled toward one another. The angling of the center axes of the sockets 22 and 24 is presently preferred with each such axis extended at an angle relative to vertical of between approximately 20 degrees and 45 degrees. The sockets 22 and 24 are relatively centrally located in the support members 26 and 28 but such location is not critical.

As shown best in FIGS. 3 and 4, the support members 26 and 28 are interconnected by a flexible cable 34 that may comprise a rope made from any suitable material such as cotton or, preferably, polypropylene. The ends of the cable 34 may simply be connected to eyelets on the support members 26 and 28, which may be formed as illustrated by holes 36 and 38 extending vertically through the bodies of the respective support members 26 and 28. Preferably, the cable 34 will lie on the ground so that its ends extend upwardly through the holes 36 and 38 and may be knotted as indicated in 40 and 42, respectively, to provide stops that prevent the cable 34 from being drawn through the holes 36 or 38. Preferably the axes of the sockets 22 and 24 and the axes of the holes. 36 and 38, when the barrier device is fully assembled, are aligned in a common plane with the eyelet holes 36 and 38 located along the end faces of the support members 26 and 28 which are closest to each other. This relationship is for ease in assembly.

For purposes of erecting the arch assembly of this invention on the ground, one of the support members, for example the support member 26, may be fixed in position by driving the spikes 30 associated therewith into the ground. Then one may take the other support member 28 and position it sufficiently remotely from the support member 26 that the cable 34 is drawn relatively taut. Accordingly, it is seen that the cable 34 must be formed of the appropriate length to create the desired spacing between the support members 26 and 28. After the spacing is obtained, the spikes 30 associated with the support member 28 are then driven into the ground. The rod 12 is assembled with the support member 26 by inserting one end into the socket 22 and bending the bar 12 and inserting its other end into the socket 24. This assembly may be done either before or after the other support member 28 is fixed to the ground. When assembled the resiliency of the bar 12 will cause the ends thereof in the sockets 22 and 24 to push the support members 26 and 28 away from each other, such bias being resisted by the spikes 30.

With reference to FIG. 2, the tube 16 is seen to comprise an elongate hollow cylindrical tubular body member 44 that is preferably formed from any suitable plastic, polyvinylchloride presently being the material of choice. Such tubes, called "rigid PVC tubes", are commercially available for use as electrical conduit. One end of the tubular body member 44 is provided with an internally threaded female connector 46 and the opposite end with an externally threaded male connector 48. Such connectors are also commercially available for use with the conduit and may be applied to the ends of the conduit thereof with a suitable cement. Tube 18 is constructed identically to tube 16 and tubes 14 and 20 are provided at one end each with the appropriate fitting for threaded connection to the respective adjacent ends of the tubes 16 and 18. As seen in FIG. 3, the free ends of the endmost tubes 14 and 20 are not provided with connectors. Rather these ends are simply slidably inserted into the sockets 22 and 24 which are sized and shaped to snugly receive them.

The overall length of the rod 12, the spacing between the support members 26 and 28, and the angle at which the center axes of the sockets 22 and 24 extends are selected to provide an arch having the desired length and height. Other dimensions are possible, as will be further described below, but an arch having a maximum height in the range of approximately 5 to 6 feet is often desireable. Such an arch assembly may be used for many different games, the nature and variety of which are entirely within the imagination of the users. I have found that a suitable arch may be formed from four κ inch PVC tubes each of which is approximately 5 feet in length so that the overall unbent length of the rod 12 is 20 feet. This rod, if used with support members 26 and 28 spaced apart so that the sockets 22 and 24 are approximately 15 feet apart and the sockets lie at an angle of approximately 30 degrees relative to vertical, will provide an arch that is approximately 15 feet long and 5½ feet high at its maximum. Support members 26 and 28 for the arch assembly may suitably comprise 2 inch×8 inch dimensional lumber plates cut to a length of approximately 7 to 10 inches.

With reference to FIG. 5, a modified support member 50 is illustrated which has a larger area extending beyond the arch-forming rod 12 than have the support members 26 and 28 illustrated in FIGS. 1, 3 and 4. A usable support member for this purpose could be made from a piece of 2"×6" dimensioned lumber having a length of approximately 10 to 12 inches. The purpose of the larger area is to enable one to place a weight such as a sack 52 of cement or the like on top of the support member 50 so that the support member 50 will be held down without using spikes. Accordingly, the modification of FIG. 5 may be used on various playing surfaces, such as floors or paved surfaces as well as on the ground.

Figure 6:
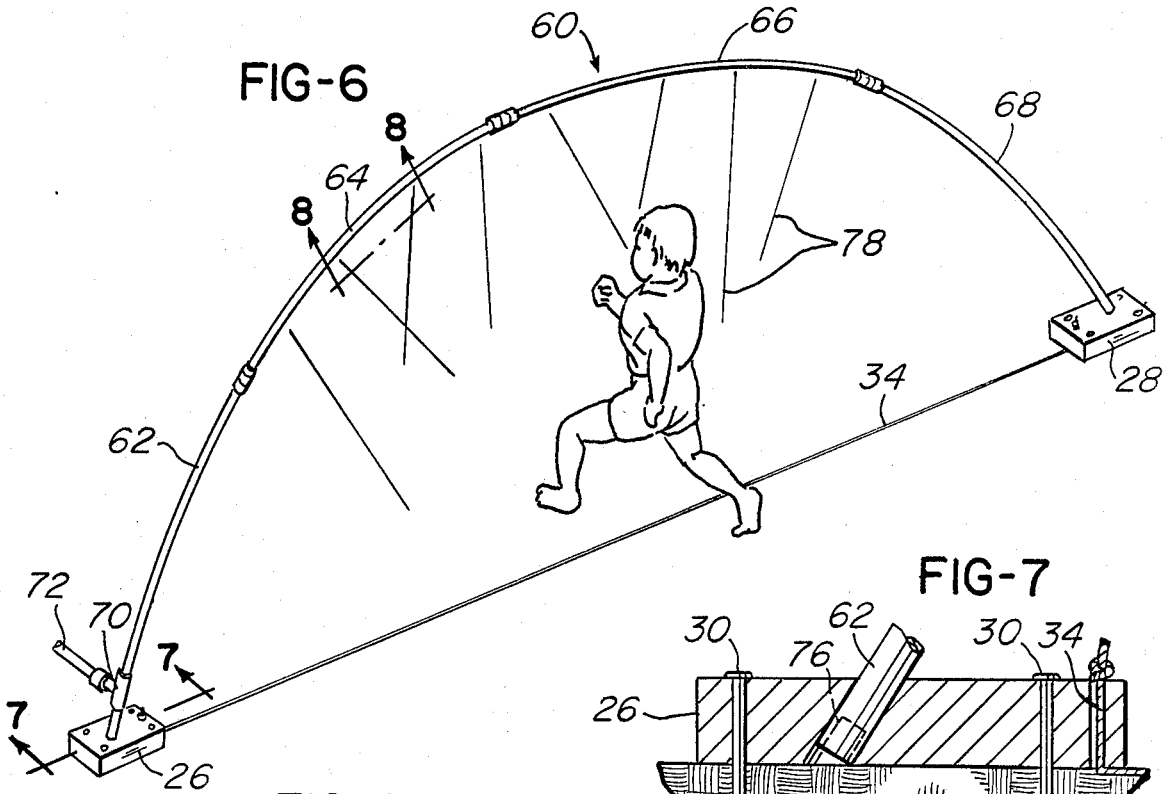
FIG. 6 is a perspective view of a further modification wherein the device is also adapted for use as a sprinkler.
Figure 7:
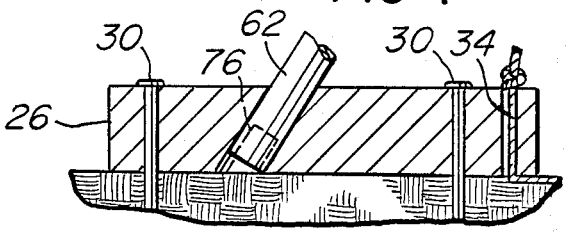
FIG. 7 is an enlarged sectional view of the modification of FIG. 6 as viewed in the direction of arrows 7—7 thereof.
Figure 8:
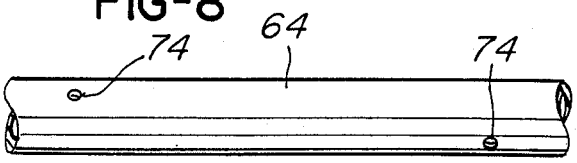
FIG. 8 is an enlarged fragmentary view of a portion of the device of FIG. 6 taken along line 8—8 thereof.

In the modification of FIG. 6, there is an arch assembly having the advantages of the assembly of FIG. 1 adapted also to act as a sprinkler under which, as illustrated, children can play. The assembly of FIG. 6 includes a rod 60 made from four, hollow tubular sections 62, 64, 66 and 68 that may be respectively identical to the tubes 14, 16, 18 and 20 described above, with the following exceptions:

1. End section 62 is provided with a T-shaped hose connector 70 communicating with its hollow interior for connection to a water hose such as indicated at 72.

2. The center sections 64 and 66 have several perforations or small apertures 74 extending through the walls thereof.

3. The end section 62 is capped or plugged as indicated at 76 in any suitable manner so that water entering through the hose connector 70 will be directed through the arch forming rod 60. The other end section 68 is also suitably plugged. Accordingly, the arch assembly of FIG. 6 may be connected to a source of water under pressure through hose 72 to create a water spray as indicated by the spray lines 78 in FIG. 6.

Figure 9:
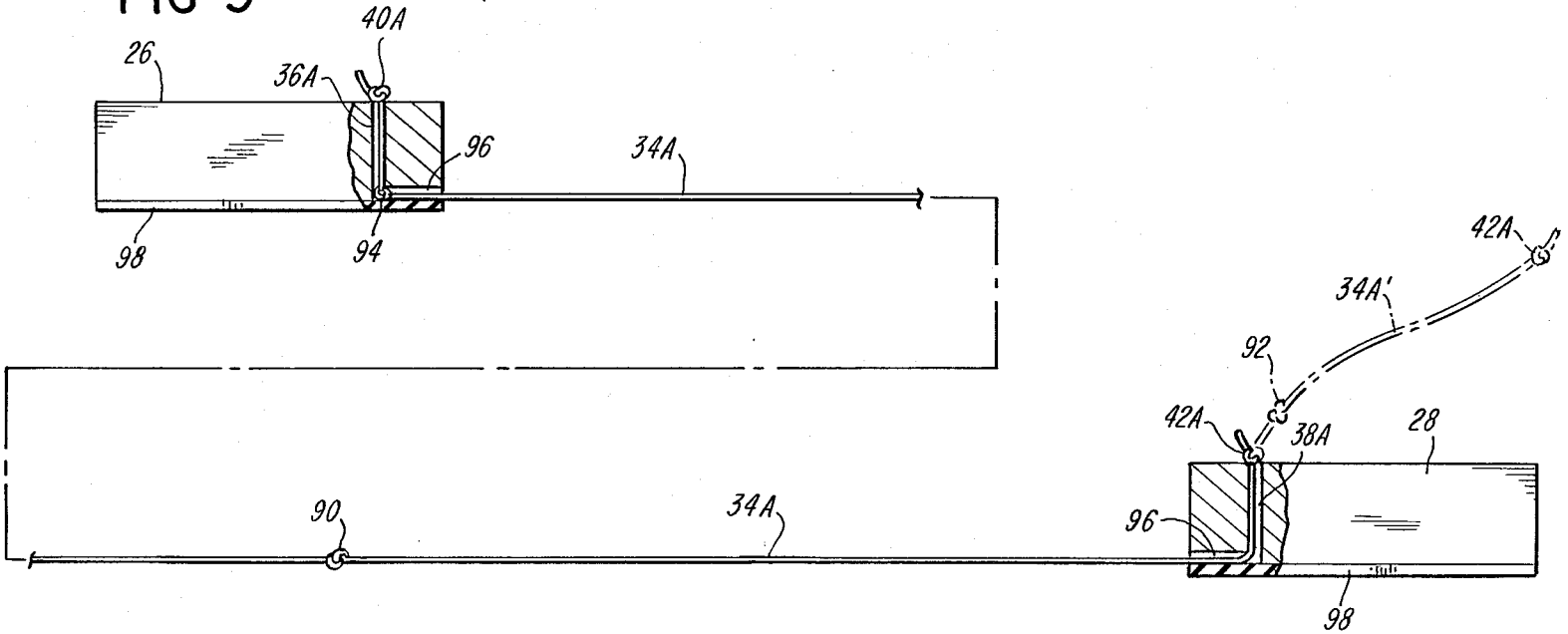
FIG. 9 is a side view, with parts broken away, of a pair of support members and a preferred cable used to maintain the desired spacing of the support members and enabling changes in the separation between the support members and thereby the height of the arch.
Figure 10:
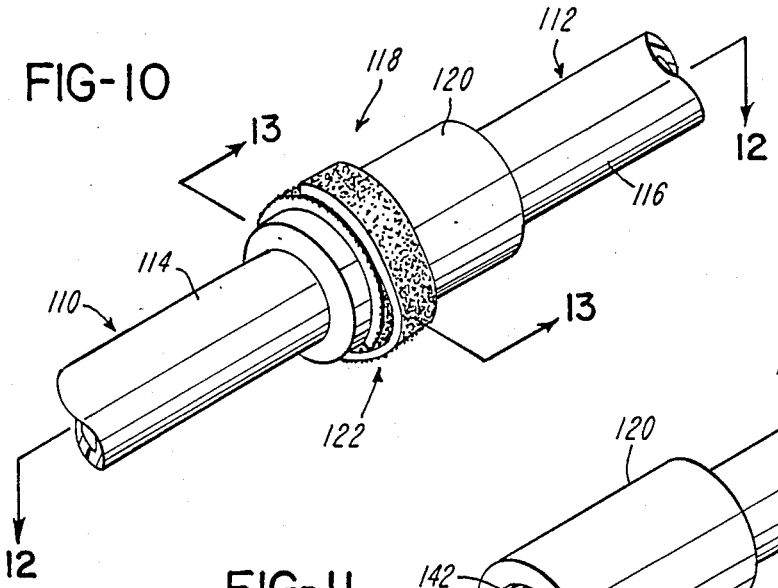
FIG. 10 is a fragmentary isometric view parts of two structural elements coupled together in accordance with the preferred practice of this invention and illustrating means for coupling them together.
Figure 11:
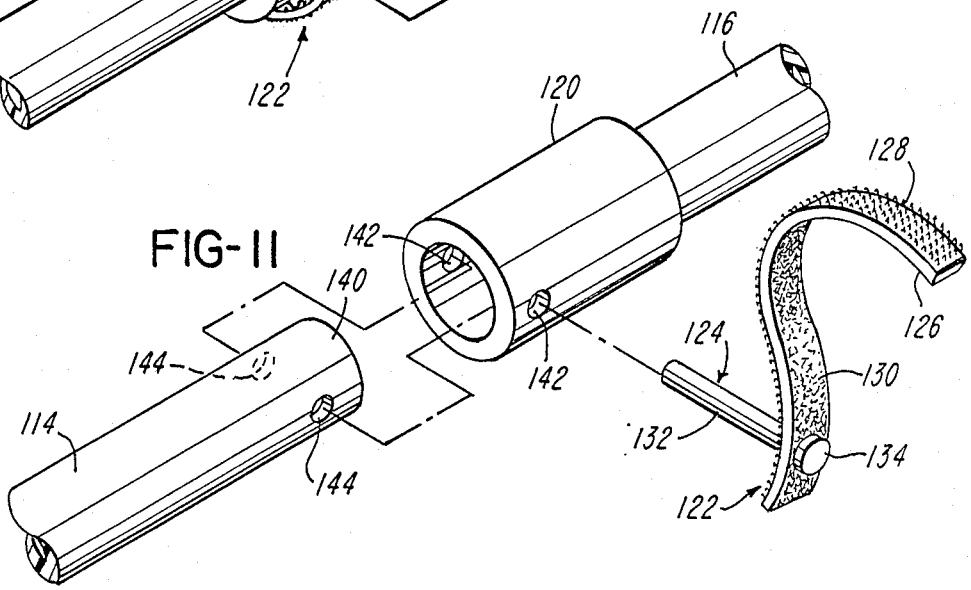
FIG. 11 is a fragmentary exploded view of the parts illustrated in FIG. 10.
Figure 12:
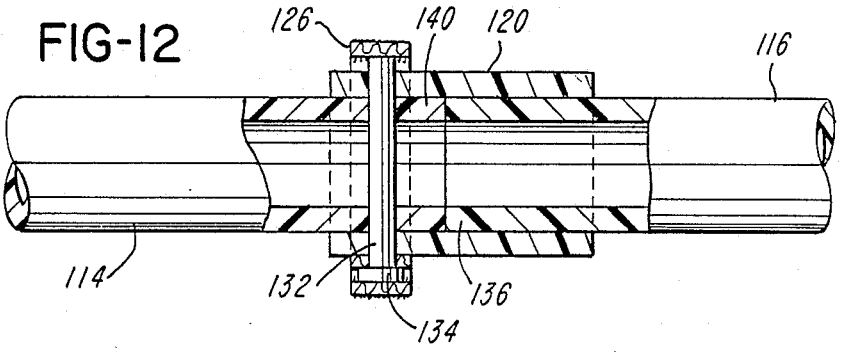
FIG. 12 is a partial longitudinal cross-sectional view of the parts shown in FIG. 10 taken in the direction of arrows 12—12 thereof.
Figure 13:
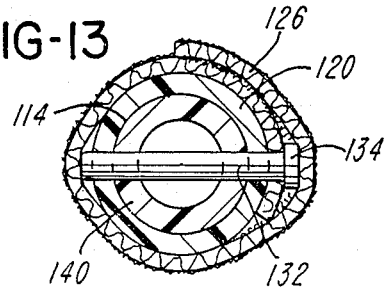
FIG. 13 is a partial transverse cross-sectional view of the parts shown in FIG. 10 taken in the direction of arrows 13—13 thereof.

FIG. 9 shows a useful modification of the cable, designated 34A therein, used to provide various different spacings between the support members 26 and 28. The cable 34A has stops 40A and 42A which are larger than the holes 36A and 38A. Stops 40A and 42A are formed by knots at the opposite ends of the cable 34A which in this respect may be identical to the previously described cable 34. In addition, the cable 34A has an inner stop 90 formed by a knot therein approximately four feet from the end of the cable 34A nearest the support member 28. The cable 34A is approximately two feet longer than the cable 34 of FIG. 3 and, if the full length of the cable 34A is stretched so that it becomes taut, the spacing between the support members 26 and 28 will be about two feet greater than the maximum spacing permitted by the cable 34 of FIG. 3. Accordingly, the use of the longer cable 34A permits the assembly of a barrier device wherein the maximum height of the arch is lower than is possible using the cable 34 of FIG. 3. The height of the arch can be increased by pulling the cable 34A through the hole 38A, as indicated by phantom lines 34A and tying another knot 92 which cannot be drawn through the hole 38A. Then, when the support member 28 is pulled away from the support member 26 until the length of the cable 34A between them becomes taut, the spacing between the two support members will be less than maximum and the arch will be higher. Knot 92 could be temporarily formed along the length of the cable 34A between the stops 42A and 90, and drawn to the top end of the hole 38A to fit the desires of the user as to the height of the arch. It may be noted that an arch having the height of that described in FIGS. 1-4 would be formed if the knot 92 is tied approximately midway between the stops 42A and 90. The ability to adjust the arch height in this manner is an advantage if the arch is to be used by groups of children of different ages at different times or for games requiring barriers of different heights.

The inner stop 90 is used as a limit to prevent the formation of an arch that is too high. In general, the stops 42A and 90 are spaced apart by an amount that permits substantial latitude of adjustment (approximately four feet) of the spacing between the support members 26 and 28 without exceeding a greater or a lesser spacing that would place excess strain on the arch forming rod or on the support members when the barrier device is assembled.

Preferably, the inner stop 90 and the outer stops 40A and 42A are rendered substantially permanent, such as may be accomplished by heating and thereby softening and melting together the strands of thermoplastic rope so that maximum safe adjustments will not be exceeded. The stop 92 can be a temporary stop, made by forming a simple bend, which would abut against the top of the hole 38A. Another permanent stop 94 is preferably formed in the cable 34A at the lower end of the hole 36A in the support member 26. The purpose of the permanent stop 94 is to restrain the user from pulling the cable 34A through the hole 36A so as to separate the stop 42A from the support member 26 which, with a corresponding pulling of the cable 34A through the hole 38A, could create a condition wherein the support members 26 and 28 are so closely spaced together that the rod when bent to an arch shape would be placed under excessive stress.

FIG. 9 shows two other refinements in the game barrier device. Channels 96 are formed in the center of the lower surfaces of the confronting ends of the support members 26 and 28. These communicate with the bottoms of the holes 36A and 38A and are designed to receive the cable 34A. Accordingly, sections of the cable 34A which otherwise would lie on the supporting surface, and thereby raise one end of each of the support members 26 and 28 above the supporting surface, nest within the channels 96. The support members 26 and 28 can thereby rest entirely upon the supporting surface. Additionally, for use on a smooth floor, the support member 26 and 28 are provided with a non-skid support plate 98, which could be a rubber mat, to assist in restricting the support members from sliding about, especially on a floor or other smooth surface.

It should be apparent that arches may be made from more or less than four sections. Also, the arch forming rods may be formed from material other than rigid PVC conduit. Here it may be noted that, although such conduit is characterized in the trade as "rigid", the conduit sections are sufficiently flexible to bend, as are the rods formed from the sections, without fracturing to enable the arch assemblies to be formed. In general, the cross-sectional dimensions and properties of the tubular bodies 44 will depend upon the length and the degree of bending required to form an arch. Although cylindrical tubular sections are shown such sections could be made from other cross sectional shapes.

At the time of the filing of the original application for this invention, the form of connectors between the tubular sections illustrated in FIG. 2 was preferred because threaded connectors reliably prevent the tubular sections from separating when the barrier device is in use and because such threaded connectors are readily available and easily assembled. It has since been found that the thread grooves are backed by such thin wall sections that, when using a game barrier device of this invention which may be subject to highly abusive treatment, the threaded connectors may be broken, and the need exists for inexpensive means for simply and quickly assembling the tubular sections that will reliably prevent the tubular sections from separating when in use and that will provide a more rugged assembly than is provided by threaded connectors.

FIGS. 10–13 show improved connection means in accordance with this invention applied to two of the arch-forming tubes, designated 110 and 112, comprising elongate, hollow, cylindrical, tubular body members 114 and 116, respectively, which are preferably PVC tubes that are identical to the tubular body members 44 described above. Body members 114 and 116 may be rapidly and reliably connected and disconnected by a connection assembly, generally designated 118, that includes a hollow, unthreaded connector sleeve 120 and connection means 122 in the form of a connector pin 124 and an elongate, flexible, fabric, fastener strap 126 having an array of hooks 128 along one face and loop pile 130 covering its opposite face, the strap 126 being of the type sold under the trademark VELCRO®. Connector pin 124 is preferably made of metal and comprises an elongate shank 132 having a larger diameter head 134. Shank 132 extends through one end of the fastener strap 126.

Connector sleeve 120 has an internal diameter substantially equal to the outer diameter of the tubular body members 114 and 116. Sleeves of this type are commercially available for use with PVC tubes and may be applied to the ends of the tubes with a suitable cement. In this case, the sleeve 120 is cemented to one end 136 of the tube 116 and extends past its end wall 138 to form, with the end wall 138, a female receptacle for slidably receiving the confronting end 140 of the tube 114. The portion of the sleeve 120 projecting beyond the end wall 138 has a pair of diametrically aligned apertures 142 with which a pair of diametrically aligned apertures 144 in the confronting end of the tubular body member 114 may be aligned by insertion of the end of the tube 114 in the open end of the sleeve 120.

As apparent from an inspection of FIGS. 10–13, the arch-forming tubes 110 and 112 may be quickly and simply connected together end-to-end by inserting the end of the tube 114 into the open end of the sleeve 120, aligning the tube apertures 144 with the sleeve apertures 142, inserting the pin shank 132 through both pairs of apertures 142 and 144, and then wrapping the fastener strap 126 completely circumferentially around the parts thus assembled so that its array of hooks 128 engage the loop pile 130. The fastener strap 126 is sufficiently long that it extends considerably beyond 360 degrees of the circumference of the sleeve 120 so that it covers the ends of the pin 124 and so that an adequate length of the hooks 128 are engaged with the loop pile 130 to securely hold the pin 124 against movement out of the apertures 142 and 144.

Those familiar with VELCRO fasteners will recognize that the ends of the strap 126 may easily be pulled apart in order to enable the parts to quickly and easily disassembled. Although other types of connectors may be used, provided that they are capable of preventing the tubular sections from separating during use, the connector assembly 118 is presently preferred because the connection is strong in the sense that it is more resistant to failure due to abuse than threaded connectors, as well as being inexpensive and easy to use.

It will be understood that each of the tubes 110 and 112 could have a sleeve 120 at one end and apertures 144 at the other end. These could constitute the middle two tubes and be used with a pair of end tubes (not shown), one of which has apertures 144 at one end and the other having a sleeve 120 at one end, for connection respectively to the tubes 110 and 112.

From the foregoing, it is seen that game barrier assemblies are provided which may be easily assembled for use and later disassembled into parts that are relatively small and lightweight and thus may be easily transported. To disassemble, the steps of assembling may simply be reversed, starting by sliding the ends of the arch-forming bar from the support member sockets, then separating the tubular sections from one another, and lifting the support members from the ground or floor. Advantageously, the devices of this invention can readily be either assembled or disassembled by one person in just a few minutes.

An arch of this invention is substantially freestanding since only short lengths of the end sections of the arch forming rod are held in the support member sockets. The arch is otherwise entirely unsupported. No guys or the like are needed. Because of the manner in which the arch forming rods are supported and the construction thereof, the entire arch is held in a vertical plane by virtue of the snug fit between the ends of the arch-forming bar and the support member sockets unless it is forced to one side or another such as by a contestant or ball accidentally striking the arch whereby it resiliently bends out of the original vertical orientation.

Although the preferred embodiments of this invention have been described, it will be understood that various changes may be made within the scope of the appended claims.

Having thus described my invention, I claim:

1. A game barrier device for forming an arch-shaped barrier of adjustable height comprising:

a pair of support members;

each of said support members having a socket;

each of said support members being constructed to lie on the ground or other generally horizontal playing surface with its said socket facing upwardly at an angle so that the center axes of said sockets intersect one another above said playing surface;

an elongate substantially free-standing rod having a self-supporting shape, capable of being bent into an arch shape, and being formed from plural, releasably interconnected rod sections each having a length convenient to be transported about by one person, said rod having an unbent length of approximately 15 feet or more and having end portions sized to be received within said sockets so that said end portions may be inserted into said sockets in alignment with said center axes by bending said rod into an arch shape; and means for holding said support members at adjustably fixed relative spacings on the playing surface so that arches of different heights may be formed by spacing said support members at different spacings with said rod received in said sockets.

2. The device of claim 1 wherein each of said sections comprises hollow plastic tubing.

3. The device of claim 2 wherein each of said sections is approximately 5 feet long.

4. The device of claim 1 wherein said rod has an unbent length of approximately 20 feet and said rod when bent to said arch shape has a maximum height above the playing surface in the range of approximately 5 to 6 feet.

5. The device of claim 1 further comprising a flexible cable connected to both of said support members, wherein said cable has a length such that said sockets are spaced apart by approximately 15 feet when said support members are spread far enough apart to place said cable under tension, and wherein said rod has an unbent length of approximately 20 feet and, when formed into said arch shape utilizing said sockets spaced apart by approximately 15 feet, has a maximum height above the playing surface in the range of 5 to 6 feet.

6. A game barrier device for forming an arch-shaped barrier of adjustable height comprising:

a pair of support members;

each of said support members having a socket;

each of said support members being constructed to lie on the ground or other generally horizontal playing surface with its said socket facing upwardly at an angle so that the center axes of said sockets intersect one another above said playing surface;

an elongate substantially free-standing rod having a self-supporting shape, capable of being bent into an arch shape, and being formed from plural, releasable interconnected rod sections each having a length convenient to be transported about by one person, said rod having an unbent length of approximately 15 feet or more and having end portions sized to be received within said sockets so that said end portions may be inserted into said sockets in alignment with said center axes by bending said rod into an arch shape; and means for holding said support members at adjustably fixed relative spacings on the playing surface so that arches of different heights may be formed by spacing said sockets, different spacing with said rod received in said sockets, said holding means comprising a flexible cable extending through holes in said support members and having stops adjacent its ends which are larger than said openings to said holes so that said support members may be spaced apart by a maximum distance determined by the distance between said stops.

7. The device of claim 6 wherein said cable is further provided with a stop intermediate said support members so that said cable may be passed through one of said support members until said last mentioned stop reaches the hole therein to thereby reduce the spacing between said support members.

8. The device of claim 7 wherein said cable has stops adjacent both ends of the hole in the other of said support members to restrain the passing of the cable therethrough.

9. A game barrier device forming an arch-shaped barrier of game barrier device for forming an arch-shaped barrier of adjustable height comprising:

a pair of support members;

each of said support members having a socket;

each of said support members being constructed to lie on the ground or other generally horizontal playing surface with its said socket facing upwardly at an angle so that the center axes of said sockets intersect one another above said playing surface;

an elongate substantially free-standing rod having a self-supporting shape, capable of being bent into an arch shape, and being formed from plural, releasably interconnected rod sections each having a length convenient to be transported about by one person, said rod having an unbent length of approximately 15 feet or more and having end portions sized to be received within said sockets so that said end portions may be inserted into said sockets in alignment with said center axes by bending said rod into an arch shape;

one of said sections having a female receptacle affixed to one end and projecting beyond said one end, said receptacle having a pair of diametrically aligned apertures, an adjacent one of said sections having an end located within said receptacle and provided with a pair of diametrically aligned apertures, said last mentioned rod sections being releasably interconnected by a pin inserted in said apertures of said receptacle and said last mentioned end, and fastener strap encircling said receptacle in covering relation to the ends of said pin and;

means for holding said support members at adjustably fixed relative spacings on the playing surface so that arches of different heights may be formed by spacing said support members at different spacings with said rod received in said sockets.

10. The device of claim 9 wherein said pin has an enlarged head and an elongate shank, and said shank extends through one end of said strap.

11. The device of claim 10 wherein said strap has a loop pile and an array of hooks which are interengaged for securing portions of said straps together with said strap thereby held in encircling relation to said receptacle.

12. The device of claim 11 wherein said receptacle comprises a sleeve partly encircling said one end of said second rod.

13. A connector for connecting a first rod and a second rod in end-to-end relationship, one end of said first rod being diametrically apertured, said connector comprising:

a female receptacle projecting beyond one end of said second rod shaped and sized to receive said aperture having a pair first rod, wall portions of said female receptacle having a pair of diametrically aligned apertures, sot that said one end of said first rod may be inserted into said female receptacle with the apertures of said first rod and said receptacle aligned;

a pin for insertion in said apertures of said receptacle and said first rod;

a fastener strap connected to said pin and adapted to encircle said receptacle in covering relation to the ends of said pin when inserted therein; and means for maintaining said fastener strap encircled about said receptacle.

14. The connector of claim 13 wherein said pain has an enlarged head and an elongate shank, and said shank extends through one end of said strap.

15. The connector of claim 14 wherein said means for maintaining said fastener strap encircled about said receptacle comprises a loop pile and an array of hooks on said strap which are interengaged for securing portions of said strap together.

16. The connector of claim 15 wherein said receptacle comprises a sleeve partly encircling said one end of said second rod.

* * * * *

UNITED STATES PATENT AND TRADEMARK OFFICE

CERTIFICATE OF CORRECTION

PATENT NO. : 4,822,053

DATED : April 18, 1989

INVENTOR(S) : Eleanor L. Flaherty

It is certified that error appears in the above-identified patent and that said Letters Patent is hereby corrected as shown below:

Column 1, line 7, "1985" should be --1985,--; column 1, line 57, "i" should be --in--. Column 3, line 52, after "Fig. 3" insert --the center axis of the socket 22 intersects--. Column 4, line 7, "holes." should be --holes--; column 4, line 63, "k" should be --½--. Column 5, line 64, "34A" should be --34A'--. Column 6, line 52, "member" should be --members--. Column 8, line 1, "to quickly" should be --to be quickly--. Claim 6, line 24, "sockets" should be --support members at--; claim 6, line 24, "spacing" should be --spacings--. Claim 9, line 1, "device" should be --device for--; claim 9, line 2, delete "of game barrier device for forming an arch-"; claim 9, line 3, delete "shaped barrier"; claim 9, line 30, "and fas-" should be --and a fas--. Claim 11, line 3, "straps" should be --strap--. Claim 13, line 7, "ture having a pair" should be --tured end of said--; claim 13, line 9, "sot" should be --so--. Claim 14, line 1, "pain" should be --pin--.

Signed and Sealed this

Fifth Day of March, 1991

*Attest:*

HARRY F. MANBECK, JR.

*Attesting Officer*

*Commissioner of Patents and Trademarks*